United States Patent [19]

Heikkinen

[11] Patent Number: 5,002,157

[45] Date of Patent: Mar. 26, 1991

[54] ELEVATOR MACHINE HAVING A DRIVE SHAFT SUPPORTED BY A SELF-ALIGNING BEARING

[75] Inventor: Urho J. Heikkinen, Espoo, Finland

[73] Assignee: Kane Elevator GmbH, Baar, Switzerland

[21] Appl. No.: 376,481

[22] Filed: Jul. 7, 1989

[30] Foreign Application Priority Data

Jul. 7, 1988 [FI] Finland ..... 883245

[51] Int. Cl.[5] ..... B66B 11/04

[52] U.S. Cl. ..... 187/20; 187/27

[58] Field of Search ..... 187/17, 20, 23, 27

[56] References Cited

U.S. PATENT DOCUMENTS

| | | | |
|---|---|---|---|
| 1,797,512 | 3/1931 | Ohler | 187/27 |
| 4,422,531 | 12/1983 | Ohtomi et al. | 187/20 |
| 4,679,661 | 7/1987 | Gibson | 187/20 |
| 4,739,969 | 4/1988 | Eckersley et al. | 187/27 X |

FOREIGN PATENT DOCUMENTS

| | | | |
|---|---|---|---|
| 2199299 | 7/1988 | United Kingdom | 187/27 |

*Primary Examiner*—Andres Kashnikow
*Assistant Examiner*—Kenneth DeRosa
*Attorney, Agent, or Firm*—Sughrue, Mion, Zinn, Macpeak & Seas

[57] ABSTRACT

In an elevator machine consisting of a drive motor, a drive shaft driven by the motor, a gear assembly to reduce the rotational speed of the motor, a brake, and a traction sheave transmitting the motion to the elevator car and counterweight by means of ropes, the drive shaft being supported at its ends by bearings, one of which is constituted by the toothing between the drive shaft and one or more intermediate gears belonging to the gear assembly, the gear assembly is located inside the traction sheave and the bearing arrangement at one end of the drive shaft comprises a self-aligning bearing and a self-aligning coupling between the motor and the drive shaft.

6 Claims, 2 Drawing Sheets

ELEVATOR MACHINE HAVING A DRIVE SHAFT SUPPORTED BY A SELF-ALIGNING BEARING

BACKGROUND OF THE INVENTION

1. Field of the Invention

The present invention relates to an elevator machine. More particularly, it relates to an elevator machine consisting of a drive motor, a drive shaft purposed to be driven by the motor, a gear assembly purposed to reduce the rotational speed of the motor, a brake, and a traction sheave purposed to transmit motion of the drive shaft to the elevator car by means of ropes, the drive shaft being supported at its ends by bearings, one of which is constituted by the toothing between the drive shaft and one or more gearwheels belonging to the gear assembly.

2. Description of Related Art

The commonest type of reduction gear used between the drive motor and traction sheave of an elevator is the worm gear. However, as the worm gear has a relatively low efficiency, there has been a trend towards the use of other types of reduction gear. Worm gears have been replaced e.g. by spur gears, which have a better efficiency, especially at start-up. A disadvantage with currently used spur gears is that the gear assemblies are bulky and therefore impractical.

SUMMARY OF THE INVENTION

An object of the present invention is to create an elevator machine that is more efficient than machines with worm gears and less bulky than currently used spur gear machines and is therefore easier to install.

In a preferred embodiment of the invention the gear assembly is located inside the traction sheave and the bearing arrangement at one end of the drive shaft comprises a self-aligning bearing and a self-aligning coupling between the motor and the drive shaft.

In a preferred embodiment of the invention the self-aligning bearing at the drive shaft end facing the motor is located inside the coupling and in substantially the same vertical plane with the coupling.

In another preferred embodiment of the invention the self-aligning coupling is provided with coupling elements which are either rigid or elastic.

In a further preferred embodiment of the invention the self-aligning coupling consists of a number of cylindrical rubber elements secured at even distances on the same circular line. They may be secured with, for example, bolts and nuts.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
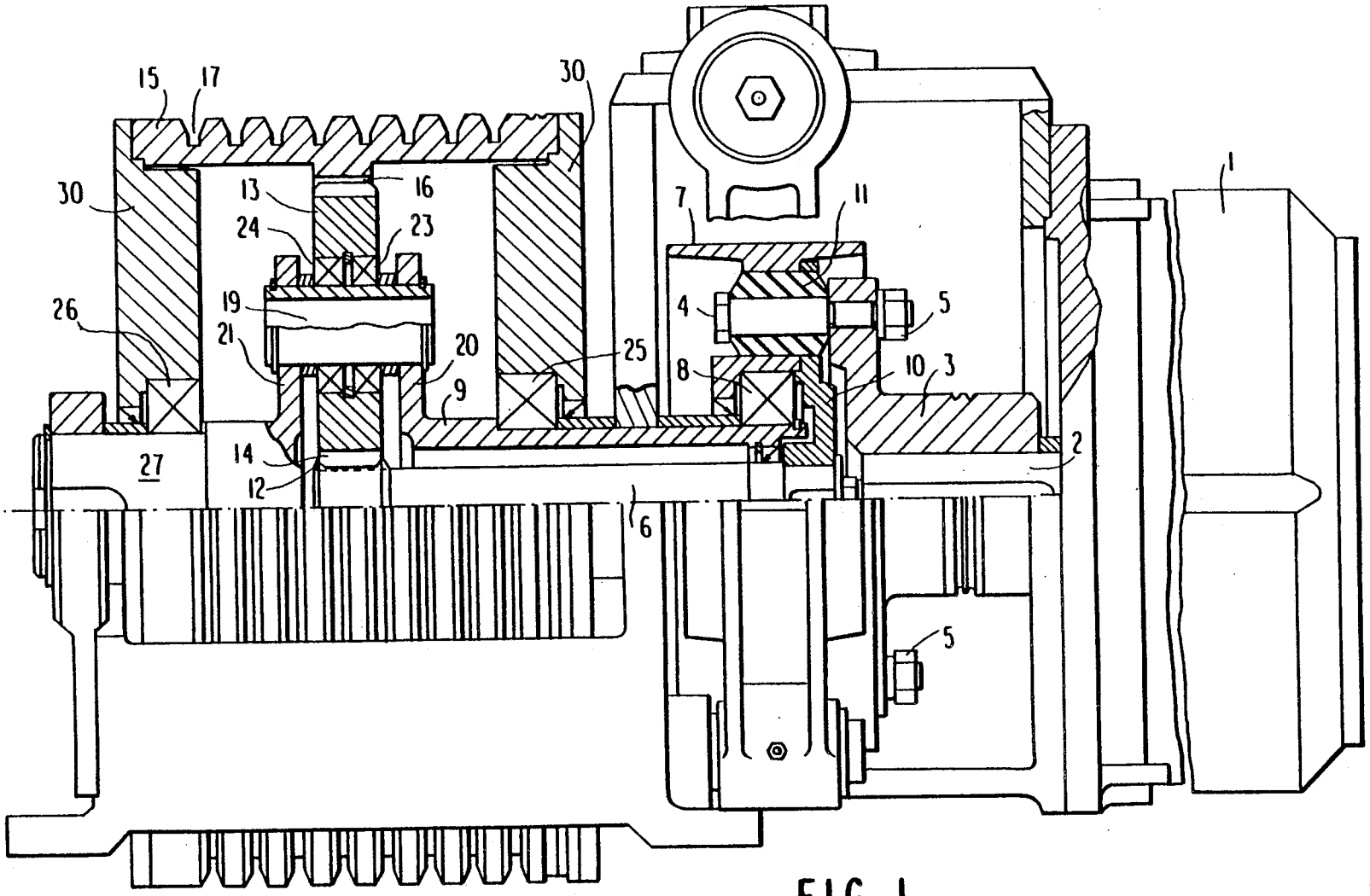
FIG. 1 is a side view of an embodiment of the elevator machine of the invention, in partial cross-section.

Referring to FIG. 1, a drive motor 1 is purposed to power a shaft 2 which has a flange 3 fixed to it. The flange is attached with bolts 4 and nuts 5 to the structure transmitting the rotational power to the drive shaft 6. There are several bolts 5, which are all placed on the same circular line at equal distances from each other along that circular line. The bolts support self-aligning coupling elements, which are, for example, cylindrical adapter elements 11 made of an elastic material such as, for example, rubber. The adapter elements may also be rigid, e.g. metallic, in which case they must have a ball-shaped surface to permit tilting.

Inside the brake drum 7 and the self-aligning coupling is a self-aligning bearing 8 which supports the rotating structure on a supporting axle 9. The drive shaft 6 is connected to element 10 and rotates with it. The drive shaft 6 is provided with a toothing 12 which is purposed to mesh with the toothing 14 of a rotating intermediate gearwheel 13. The number of intermediate gearwheels 13 is not limited. The embodiment illustrated in FIG. 2 uses three intermediate gears, but other variants are possible. The intermediate gearwheel 13 is in mesh with the traction sheave 15 via the toothing 16 provided on the interior surface of its rim. Preferably helical gearing is used, the helix angle and contact width of the teeth being selected such that the sum of the transverse contact ratio and the maximum contact ratio is as close as possible to an integer value, e.g. three. Such selection ensures that the total length of the pressure line and the engagement rigidity remain constant during engagement, resulting in a smooth tooth contact and a low noise level.

When the motor 1 rotates the shaft 2, the latter in turn transmits the rotation via the flange 3 and self-aligning coupling to the drive shaft 6. The drive shaft 6 turns the intermediate gears 13, which in turn rotate the traction sheave 15. The rim of the traction sheave 15 is provided with a number of grooves 17, formed in a known manner and located side by side, for the suspension ropes 18 of the elevator. The number of grooves depends on the specific application and may vary greatly.

Figure 2:
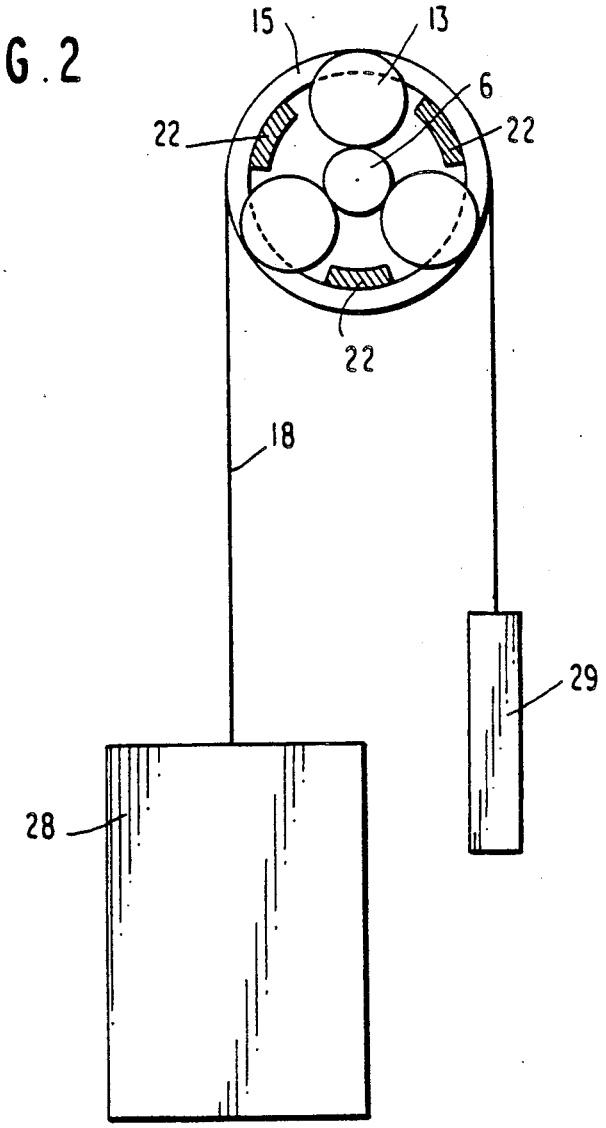
FIG. 2 is a diagram of the traction sheave, reduction gear and the elevator car and counter-weight suspended on the sheave with ropes passing around the sheave.

The drive shaft 6, which extends from the coupling to the intermediate gears 13, is surrounded by a supporting axle 9, which is fixed to the frame of the elevator machine and consists of a tubular portion adjoining the intermediate gear 13 and a flange 20 provided at the end facing the intermediate gear. On the opposite side of the intermediate gear 13 is another flange 21, which is an integral part of the fixed supporting axle 27 attached to the frame. The two flanges are connected by connecting members 22 (FIG. 2). The arrangement may contain, e.g. three such members 22, placed on the periphery of the flanges at an angular distance of 120° from each other, connecting the flanges and thus rendering the supporting axle 9 rigid.

A fixed axle 19 for the intermediate gear 13 is provided between the flanges 20 and 21, the intermediate gear 13 being supported on this axle with bearings 23, 24.

The traction sheave 15 is rotatably mounted on the supporting shaft 9 with bearings 25 and 26.

The elevator machine of the invention allows free adaptation of the drive shaft 6, because one end of the drive shaft is supported by the intermediate gears 13 and the other end by the self-aligning coupling and the self-aligning, bearing 8, which are located in substantially the same vertical plane. The axial forces acting on the drive shaft 6 and caused by the engagement of the drive shaft toothing with the intermediate gears 13 are transmitted via the bearing 8 to the frame.

Referring to FIG. 2, three intermediate gears 13 are mounted inside the traction sheave 15 between the drive shaft 6 and the interior surface of the sheave rim. When the drive shaft rotates, the intermediate gears 13 transmit the rotational power to the traction sheave, which in turn moves the elevator suspension ropes 18 by virtue of friction. The elevator car 28 is suspended at one end of the ropes 18 and the counterweight 29 is attached to the other end. Naturally, the suspension system may include one or more diverting pulleys, which are not shown in this figure.

The side walls 30 of the traction sheave 15 can be made especially massive to insulate the noise generated by the tooth contacts between gears.

It will be obvious to a person skilled in the art that the invention is not restricted to the embodiments disclosed above, but may instead be varied within the scope of the following claims without departing from the spirit and scope of the invention.

I claim:

1. In an elevator machine, consisting of a drive motor, a drive shaft purposed to be driven by said motor, a gear assembly purposed to reduce the rotational speed of the motor, a brake, and a traction sheave purposed to transmit motion of said drive shaft to an elevator car and counterweight by means of ropes, said drive shaft being supported at its ends by bearings, one of which is constituted by toothing between said drive shaft and one or more intermediate gears belonging to said assembly, said gear assembly being located inside said traction sheave and said bearings including a bearing arrangement, at one end of the drive shaft comprising a self-aligning bearing and a self-aligning coupling between said motor and said drive shaft.

2. An elevator machine according to claim 1, further providing that said self-aligning bearing is located on the same axis of rotation as said self-aligning coupling and in substantially the same vertical plane with said self-aligning coupling.

3. An elevator machine according to claim 1, wherein said self-aligning coupling is provided with coupling elements which are rigid in nature and generally spherical in shape.

4. An elevator machine according to claim 1, wherein said self-aligning coupling is provided with coupling elements which are elastic in nature and generally cylindrical in shape.

5. An elevator machine according to claim 1, wherein said self-aligning coupling consists of a number of cylindrical rubber elements secured radially about the axis of rotation.

6. An elevator machine according to claim 1, wherein said drive shaft is surrounded by a fixed, tubular and rigid supporting axle on which said traction sheave and said one or more intermediate gears are mounted with bearings.

* * * * *